US005535126A

United States Patent [19]

Mourgues

[11] Patent Number: 5,535,126

[45] Date of Patent: Jul. 9, 1996

[54] METHOD OF CHECKING DAILY CONSUMPTION OF POSTAL CHARGES BY A POSTAGE METER AND A POSTAGE METER ENABLING SUCH MONITORING TO BE PERFORMED

[75] Inventor: Bernard Mourgues, Paris, France

[73] Assignee: Neopost Industrie, Bagneux, France

[21] Appl. No.: 196,401

[22] Filed: Feb. 15, 1994

[30] Foreign Application Priority Data

Feb. 17, 1993 [FR] France ..... 93 01778

[51] Int. Cl.[6] ..... G07B 17/00

[52] U.S. Cl. ..... 364/464.02; 364/406

[58] Field of Search ..... 364/401, 406, 364/464.02, 464.03

[56] References Cited

U.S. PATENT DOCUMENTS

| | | | |
|---|---|---|---|
| 3,416,075 | 12/1968 | Rutenberg | 364/464.04 |
| 3,792,446 | 2/1974 | McFiggins et al. | 364/464.02 |
| 4,400,783 | 8/1983 | Locke, Jr. et al. | 364/483 |
| 4,495,596 | 1/1985 | Sciulli | 395/575 |
| 4,654,588 | 3/1987 | Munday | 324/103 R |
| 4,811,234 | 3/1989 | Storace | 364/464.02 |
| 4,941,091 | 7/1990 | Breault et al. | 364/406 |
| 4,980,524 | 12/1990 | Jackson et al. | 235/375 |
| 5,369,221 | 11/1994 | Ramsden | 364/464.03 X |
| 5,384,708 | 1/1995 | Collins et al. | 364/464.02 |

FOREIGN PATENT DOCUMENTS

| | | |
|---|---|---|
| 0285956A1 | 10/1988 | European Pat. Off. . |
| 0493948A2 | 7/1992 | European Pat. Off. . |
| 0493943A2 | 7/1992 | European Pat. Off. . |
| 2626995 | 8/1989 | France . |
| 2657985 | 8/1991 | France . |
| 2665003 | 1/1992 | France . |
| 2207095A | 1/1989 | United Kingdom . |
| 2233937A | 1/1991 | United Kingdom . |

*Primary Examiner*—Edward R. Cosimano

*Attorney, Agent, or Firm*—Sughrue, Mion, Zinn, Macpeak & Seas

[57] ABSTRACT

In a postage metering system, daily postage usage data is accumulated and stored over a period of time. Periodically the stored accumulated postage usage data is recovered from the postage meter system and noted on a billing form. A certification number is generated from the stored accumulated postage usage data and noted on the billing form. The certification number is then used by a billing authority to verify the correctness of the noted accumulated postage usage data in order to ensure proper billing.

6 Claims, 2 Drawing Sheets

METHOD OF CHECKING DAILY CONSUMPTION OF POSTAL CHARGES BY A POSTAGE METER AND A POSTAGE METER ENABLING SUCH MONITORING TO BE PERFORMED

The invention relates to a method of checking the daily consumption of postal charges by a postage meter, i.e. the total amount of postage franking performed by the meter on a given day.

BACKGROUND OF THE INVENTION

A conventional franking meter includes a backed-up non-volatile memory for storing total consumption, i.e. the cumulative value of all franking operations performed since the meter was put into operation. In order to be able to bill monthly consumption, and to be able to perform certain checks sporadically, the postal authorities in charge of the meter require the user to hand-fill a monthly form having one line per day. At the end of the day, the user reads the total consumption as displayed on a display of the meter, writes it down on the form, then calculates the day's consumption by subtracting the total consumption recorded on the previous day from the presently-displayed total, and writes down the day's consumption on the form as well.

Such forms present numerous difficulties:

Users are not always careful in calculating and writing down daily consumption figures, and even careful users can make mistakes.

A dishonest user may be tempted to fake the amounts declared. Provision is made for sporadic checks, but they are difficult to implement since they require an agent of the postal authority to pay a visit and read the real total consumption figure on the meter.

OBJECT AND SUMMARY OF THE INVENTION

The object of the invention is thus to make it easy to check the monthly and daily consumption as copied down by the user on the conventional monthly form. Another object of the invention is to enable the monthly form to be printed out automatically, while certifying that the information provided on the form is exact.

The invention therefore provides a method of checking daily consumption of postal charges by a postage meter.

A first method of checking consists in sending an agent of the postal authority to visit the meter to read from its display the total consumption values for the dates on which consumption is to be checked. A second method, explained below, makes it possible to avoid such a visit.

The invention also extends to a franking meter suitable for checking daily consumption in this way. Such a meter makes it possible to check total consumption, day by day, with certainty as to date. The meter makes it possible to check the exactness of a form hand-filled by the user, without requiring a visit by an agent of the postal authority, since the authority can recalculate the certification number from the consumption values written on the slip provided by the user, and can verify that it is identical to the number written by the user on the slip. This check guarantees that the daily consumption figures written on a slip filled in by a user are indeed exact. Hand-filling of a monthly slip by a user can be omitted if the meter provides the following automatically in printed form: daily consumption figures over a period of one month, the number specific to the meter, for example, and the certification number corresponding to that information. The work done by the user is thus considerably simplified.

BRIEF DESCRIPTION OF THE DRAWING

The invention will be better understood and other characteristics will appear from the following description and the accompanying drawings, wherein.

DETAILED DESCRIPTION

This example includes a protected enclosure EN containing electronic circuits that must be kept out of reach of the user in order to avoid fraud. These electronic circuits comprise:

a microprocessor M1 for implementing control functions of the postage meter in compliance with a program stored in a read only memory RM connected to the microprocessor M1 via a parallel bus PB;

two read/write memories BAM1 and BAM2 backed by a battery (not shown), these memories contain: an up-count register for the running total value of franking operations, a down-count register for the credit remaining, a register that stores the number of franking operations, and 2×31 registers for storing daily consumption over two consecutive calendar months; with all of the above registers being duplicated in the two memories respectively;

a calendar circuit CAL associated with a crystal Q and a back-up battery B;

a keypad K associated with a display D enabling an operator to give orders to the postage meter and read information concerning the operation thereof;

an optional printer P; and a switch S placed in a zone T of the enclosure EN that is accessible via an officially-sealed hatch to enable postal authority personnel to reload credit into the down-count register and to update the time and the date of the calendar circuit CAL.

The sealed hatch prevents the user of the meter from gaining access to the switch S in order to avoid any fraud concerning credit or date of franking. The meter is credited and set to the right time simultaneously, at regular intervals, e.g. once every 6 months, by a member of postal authority staff. In addition to the sealed hatch, a secret digital code may be provided that needs to be keyed onto the keypad K in order to authorize the inputting of credit or a change of date and time.

The user is entitled to frank mail a few days prior to actually depositing the mail in the post office (up to a maximum of 7 days, for example). If the user seeks to take advantage of this facility, then the keypad K must be used to offset the date as printed. The operation of the meter is controlled by the microprocessor M1 as a function of software stored in the read only memory RM. The person skilled in the art is capable of writing a software module that is stored in the memory RM for the purpose of receiving instructions from the user and of offsetting the date as printed relative to the date as given by the circuit CAL, with the offset being equal to the number of days selected by the user and less than a maximum number set in the software module.

Figure 1:
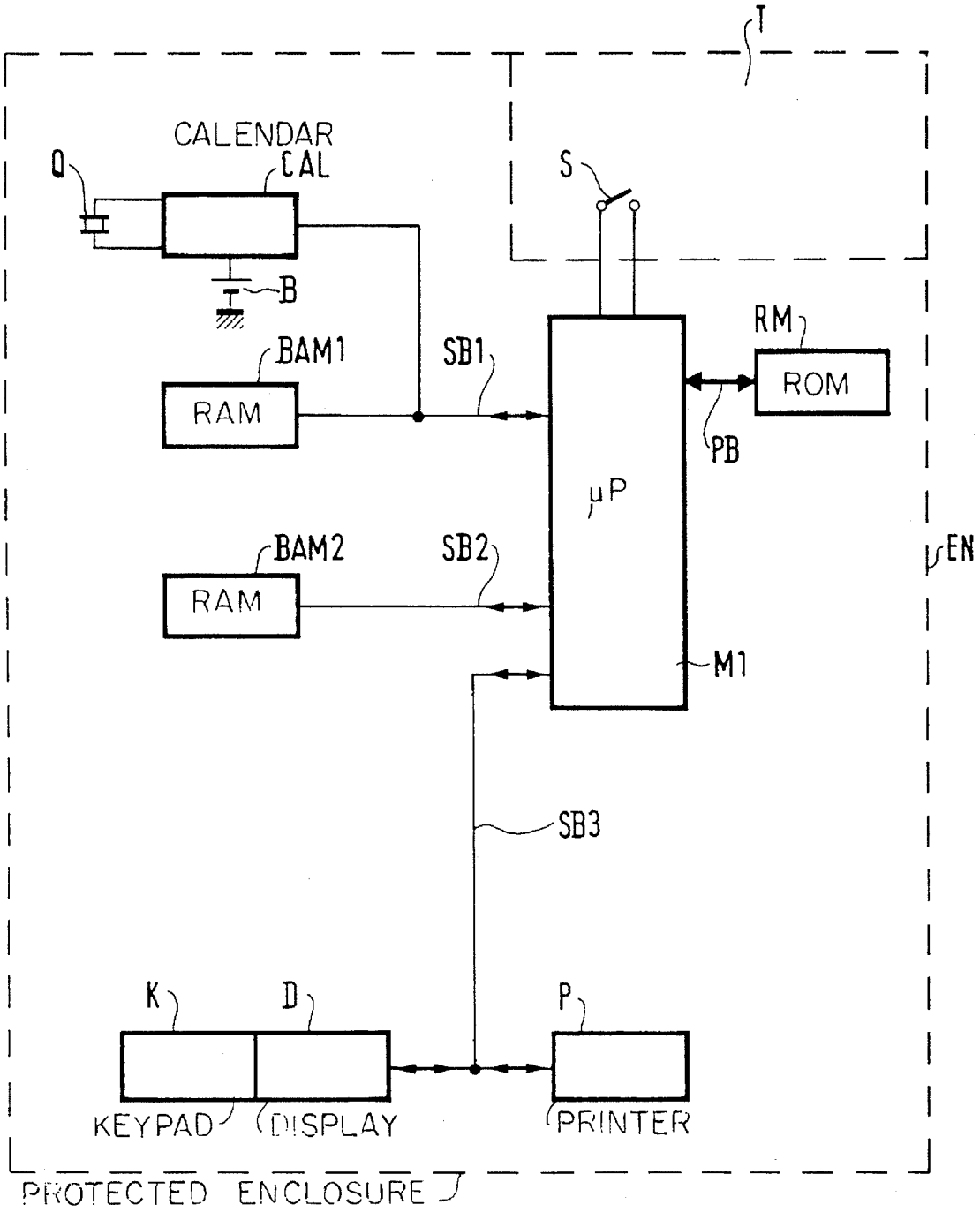
FIG. 1 is a block diagram of one embodiment of a postage meter of the invention.
Figure 2:
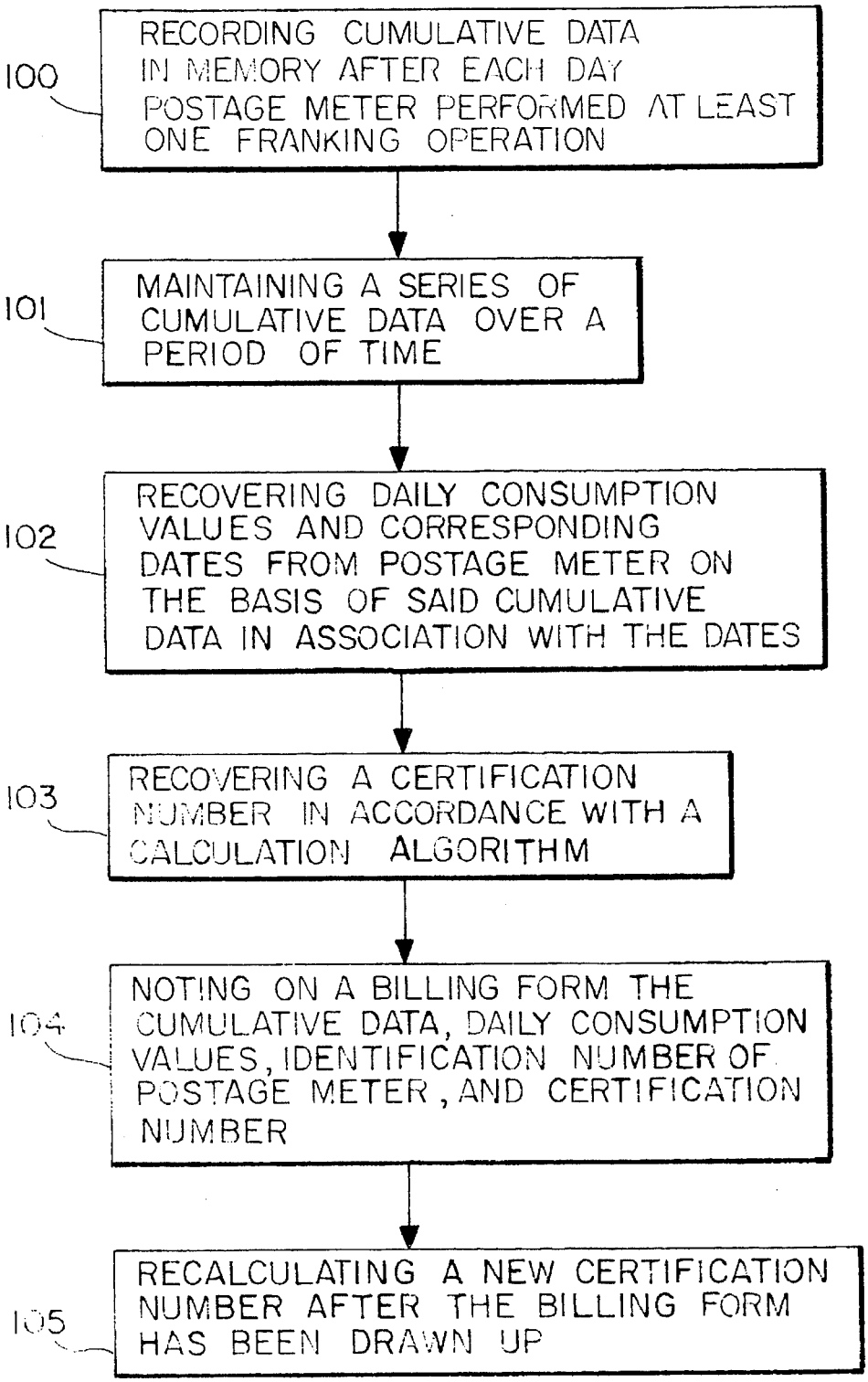
FIG. 2 is a flowchart illustrating steps performed by the embodiment shown in FIG. 1.

The operations of the embodiment shown in FIG. 1 are now described with reference to the flowchart shown in FIG. 2.

The following operations correspond to step 100.

A synchronous bus for serial transmission SB1 connects a port of the microprocessor M1 to a port of the memory BAM1 and to a port of the calendar circuit CAL. A second synchronous bus for serial transmission SB2 connects a port to the microprocessor M1 to a port of the memory BAM2. A third synchronous bus for serial transmission SB3 connects a port to the microprocessor M1 to a port of the assembly comprising the keypad K and the display D, and to a port of the printer P.

During each franking operation, the microprocessor M1 calculates the current total consumption and updates the count-up register in the memory BAM1 by writing said amount therein. It also updates the down count register and the number of operations register in the memory BAM1. It then reads back the contents of said memory to verify that each update has taken place properly. Thereafter it performs the same updating in the memory BAM2.

When it is switched on, the microprocessor M1 monitors proper operation of the clock by testing the changing of seconds, for example. In addition, it monitors the change of data that takes place at midnight.

If the meter remains switched on permanently, then each time the date changes, the microprocessor M1 reads the current total consumption amount from the memories BAM1 and BAM2. At midnight this amount becomes the amount to be archived for the day that has just elapsed. This amount together with the date is thus written in the memories BAM1 and BAM2 in a register corresponding to said day, and it remains stored therein over a period of 2 months, with the register being reused after 2 months have elapsed, as indicated in step 101. A pointer stored in each of the memories BAM1 and BAM2 serves to indicate the address of the most recently updated register.

The following operations correspond to step 102.

If the meter is switched on during periods of non-use, then the microprocessor M1 reads the date provided by the circuit CAL each time it is switched back on. It also reads the date most recently written in the memories BAM1 and BAM2. If that date does not correspond to the date provided by the circuit CAL, the microprocessor M1 concludes that at least one change of date has taken place since the most recent update. It reads the current total consumption amount from the memories BAM1 and BAM2 and it writes it together with the real date as provided by the circuit CAL in the register corresponding to said date in the memories BAM1 and BAM2. Naturally, if subsequent franking operations are performed thereafter, and if the meter is still switched on at midnight, the amount that has already been recorded will be replaced by the amount that is current at midnight.

If the postal authority in charge of the meter requires the user to hand-fill a slip indicating the daily consumption of the meter, then the printer P is not installed in the meter. The user requests the meter to read the information stored in its registers for the most recent months of use. This request is input via the keypad K. The microprocessor M1 reads the total consumption amount for each of the days in succession and displays said amount on the display D. Simultaneously, it calculates the daily consumption for each day and displays it on the display D. The user copies down onto the slip the successive values read from the display D.

Thereafter, as indicated in step 103, the microprocessor M1 calculates a "certification" number as a function of the following: a number specific to the meter and stored in the memory RM; a secret code stored in the memory RM; the total consumption values; and the daily consumption values that it has just displayed. The algorithm used for determining the certification number may, for example, be the conventional algorithm known as the Data Encryption Standard. It can be implemented by means of an ordinary microprocessor and it makes it impossible to work out the value of the secret key. The microprocessor M1 displays the certification number on the display D, and the user copies it down on the form, as indicated in step 104. The certification number can be recalculated, as indicated in step 105, by an agent of the postal authority on the basis of the number specific to the meter (which is marked on the form), of the secret code (which is naturally known to the postal authority), and of the total and daily consumption values (also marked on the form). By comparing the recalculated certification number and the number marked on the form, it is possible to determine whether the values copied down by the user are valid. A check performed on the meter itself on the user's premises need only be considered in the relatively unusual case of this verification indicating that there is an anomaly.

The embodiment shown in the figure further simplifies matters both for the postal authority and for the user. It includes a printer P enabling the microprocessor M1 to print out directly a monthly form specifying the following: the number specific to the meter, the total and daily consumption values for each day in a calendar month, and a certification number.

The person skilled in the art is capable of implementing software modules capable of performing the above functions, and of storing them in the read only memory RM.

I claim:

1. A method of checking daily consumption of postal charges by a postage meter, the method comprising the following steps:

recording cumulative data in a non-volatile memory of the postage meter after each day on which the postage meter has performed at least one franking operation, said data being representative of total consumption of postal charges metered by the meter up to said day, and being recorded in association with a date provided by a calendar circuit of the meter;

maintaining a series of such cumulative data in correspondence with respective dates in the non-volatile memory of the postage meter over a predetermined time of time;

recovering daily consumption values and corresponding dates from the postage meter on the basis of said cumulative data recorded in its non-volatile memory in association with said dates, each daily consumption value representing the consumption of postage charges metered by the meter for one day's use of the meter;

recovering from the postage meter, a certification number calculated by applying a calculation algorithm to said recovered daily consumption values, said cumulative data recorded over said period of time in the non-volatile memory, an encoding key, and an identification number of the postage meter previously recorded in the memory of the postage meter;

noting said cumulative data, daily consumption values, identification number of the postage meter, and certification number on a billing form for said predetermined period of time; and after said billing form has been drawn up, recalculating a new certification number on the basis of the cumulative data, the daily consumption values, the identification number of the meter marked on the form and an encoding key identical to that recorded in the postage meter in order to verify whether the certification number remarked on the form is identical to the new certification number calculated in this way.

2. The method of claim 1, including displaying on a display screen provided on the postage meter, said cumulative data, said daily consumption values in association with dates, the identification number of the postage meter, and said calculated certification number.

3. The method of claim 1, including automatically transferring the cumulative data, the daily franking consumption values, the identification number of the postage meter, and the certification number on a billing form by means of a printer connected to the postage meter.

4. A postage meter adapted for implementing a method of checking postal charge consumption, comprising, inside an enclosure protected against unauthorized access: means for metering total consumption of postal charges representative of franking operations performed by said meter since said meter was switched on, and for maintaining cumulative data representative of said total consumption in a non-volatile memory, a calendar circuit for delivering a date to said metering means on demand, means for writing such cumulative data in the non-volatile memory in correspondence with dates provided by the calendar circuit for each day on which at least one franking operation is performed by the postage meter, calculation means for calculating daily consumption values from said cumulative data and for calculating a certification number representative of a combination of said cumulative data recorded in the non-volatile memory, of the calculated daily consumption values, of an identification number, and of a code key recorded in the memory of the meter, and means for playing back to a user of the meter, said cumulative data, the identification number of the calculated daily consumption values, and the calculated certification number for the purpose of being marked on a billing form.

5. A meter according to claim 4, comprising a keypad for causing the calculation means to change the date in the calendar circuit or to change the cumulative data in the non-volatile memory.

6. A meter according to claim 5, including a switch placed in a zone of the enclosure that is accessible via a sealed hatch and that is connected to the calculation means.

* * * * *